US007026539B2

(12) United States Patent
Pennock et al.

(10) Patent No.: US 7,026,539 B2
(45) **Date of Patent: *Apr. 11, 2006**

(54) MUSICAL EFFECT CUSTOMIZATION SYSTEM

(75) Inventors: James D. Pennock, Salt Lake City, UT (US); Robin M. Urry, Draper, UT (US); John D. Hanson, West Jordan, UT (US); Jeremy Geisler, Sandy, UT (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/717,247

(22) Filed: Nov. 19, 2003

(65) Prior Publication Data

US 2004/0159222 A1 Aug. 19, 2004

Related U.S. Application Data

(62) Division of application No. 10/037,510, filed on Jan. 4, 2002, now Pat. No. 6,664,460.

(60) Provisional application No. 60/260,048, filed on Jan. 5, 2001.

(51) Int. Cl.
*G10H 1/02* (2006.01)
*G10H 5/00* (2006.01)

(52) U.S. Cl. ..... 84/662; 381/61; 381/118

(58) Field of Classification Search ..... 84/622, 84/626, 623, 662, 661; 381/61, 111, 118, 381/120

See application file for complete search history.

(56) References Cited

U.S. PATENT DOCUMENTS

| | | | |
|---|---|---|---|
| 4,079,199 | A | 3/1978 | Patronis, Jr. |
| 4,238,746 | A | 12/1980 | Mc cool et al. |
| 4,602,337 | A | 7/1986 | Cox |

(Continued)

OTHER PUBLICATIONS

Hammond, Shawn, X Marks The Box, Guitar World Magazine, May 2003.*

(Continued)

*Primary Examiner*—Jeffrey W Donels
(74) *Attorney, Agent, or Firm*—Brinks Hofer Gilson & Lione

(57) ABSTRACT

This invention provides a system for customizing musical instrument signal processing enabling users to produce different tonal characteristics in created musical pieces. In order to create such tonal characteristics, a new mathematical model of tonal characteristics may be digitally created based on two or more initial mathematical models of tonal characteristics. After simulating a first and second initial mathematical models of tonal characteristics, the new mathematical model is created by interpolating one or more coefficients of the first and second initial mathematical models. The new mathematical model may also adjust a control parameter where the control parameter may exist between two values. When the control parameter is the first value, the new mathematical model is the first initial mathematical model. When the control parameter is the second value, the new mathematical model may be the second initial mathematical model. When the control parameter is located at a point between the first and second values, the new mathematical model may represent a convergence between the first and second models.

33 Claims, 8 Drawing Sheets

U.S. PATENT DOCUMENTS 4,658,426 A 4/1987 Chabries et al.
5,029,217 A 7/1991 Chabries et al.
5,046,101 A 9/1991 Lovejoy
5,245,665 A 9/1993 Lewis et al.
5,345,467 A 9/1994 Lomp et al.
5,640,414 A 6/1997 Blakeney, II et al.
5,649,015 A 7/1997 Paddock et al.
5,663,517 A 9/1997 Oppenheim
5,698,807 A 12/1997 Massie et al.
5,744,742 A 4/1998 Lindemann et al.
5,789,689 A 8/1998 Doidic et al.
5,917,917 A * 6/1999 Jenkins et al. ..... 381/63
5,929,795 A 7/1999 Wang
5,937,019 A 8/1999 Padovani
5,977,470 A 11/1999 Suda
5,999,631 A 12/1999 Porayath et al.
6,018,662 A 1/2000 Periyalwar et al.
6,049,716 A 4/2000 Jung
6,073,021 A 6/2000 Kumar et al.
6,096,960 A * 8/2000 Scott ..... 84/603
6,236,283 B1 * 5/2001 Koslov ..... 332/103
6,304,846 B1 10/2001 George et al.
6,664,460 B1 12/2003 Pennock et al.

OTHER PUBLICATIONS

Millenium Stereo One-Fifty Integrated Modeling Amplifier User's Guide, Johnson Amplification, Jun. 15, 1997.*

* cited by examiner

MUSICAL EFFECT CUSTOMIZATION SYSTEM

CROSS REFERENCE TO RELATED APPLICATIONS

This application is a Divisional application of U.S. patent application Ser. No. 10/037,510, filed Jan. 4, 2002, now U.S. Pat. No. 6,664,460, titled "System for Customizing Musical Effects Using Digital Signal Processing Techniques."

CROSS REFERENCE

This application claims the benefit of U.S. Provisional Patent Application Ser. No. 60/260,048, filed on Jan. 5, 2001, and is incorporated by reference.

BACKGROUND OF THE INVENTION

1. Field of the Invention

The invention relates to audio signal processing and more specifically to a system for musical instrument signal processing that creates customized effects through mathematical manipulation of existing effects such as amplifier or loudspeaker cabinet simulation effects.

2. Related Art

During the process of creating music, musicians have always searched for the right way to express their musical ideas. Just as a composer will use different instruments within an orchestra to express music, an electric musical instrument player will choose a variety of signal processing effects to achieve a desired sound. In most cases, the amplifier is the major contributor to the resulting sound, with each brand and model of amplifier having its own characteristic sound. For example, it is not uncommon for an electric guitarist to use several different amplifier combinations in the recording studio during a recording session to achieve desired sound effects. Two or more amplifiers may even be used at the same time to achieve desired sound effects.

Electric guitar amplifiers were introduced in the 1940s and for decades their basic design remained relatively unchanged. These analog amplifiers have evolved to add tone controls, channel switching, and analog effects including reverb, tremble, and chorus to name a few examples. Yet, the core guitar system has remained the same: an electric guitar is connected to an amplifier and then to a loudspeaker for broadcasting the sound after the audio signal from the electric guitar has been processed at the amplifier. If the guitarist wanted a different sound, he would use a different guitar, amplifier, or loudspeaker.

Eventually, guitar players began inserting additional guitar effects produced by other signal processing devices into the signal chain from the guitar to the loudspeakers to obtain a wider variety of tonal characteristics or sound effects. The first and simplest guitar effects processing devices were analog pedals inserted between the guitar and the amplifier. As they evolved, a variety of both analog and digital single effects were available to the musician either as a floor pedal or a rack mounted signal processing device. Such effects pedals and rack processors added variety in tonal possibilities that were used by many guitarists to provide a plethora of effects using processors between their guitar and amplifier. The shortcomings of this approach were evident in the overall degradation of the guitar signal passing through so many individual signal processors. Also, the amount of time it would take to switch from one sound to another by adjusting each individual processing device was a limitation for the musician.

As technology has advanced, effects processor products such as the DigiTech DSP128 (released 1987) combined many effect processors into a single programmable unit. These multi-effects processors offer an integrated digital signal processor (DSP) and a simple, single user interface that allows the musician to use a variety of signal processing setups. For example, the musician may save sounds to one of several preset program locations and recall them at will. A limitation of this type of processor, however, lies in the complexity of choosing a desired sound among the immense number of possibilities that are offered.

The current state of the art for musical signal processing known to the musician is amplifier modeling. This type of processing system combines many tone shaping effects from a multi-effects processor into a single effect that will approximate the characteristics of well-known "classic" amplifiers that guitarists or other musicians desire to use. There are both modeling guitar amplifiers and modeling signal processors. Instead of buying and using several different amplifiers, a guitarist can use a modeling amplifier to approximate the tonal characteristics provided by selected "classic" amplifiers. Some modeling amplifiers, such as the Johnson Amplification JM150 (released 1997), even allow the user to simulate using two different classic amplifiers at the same time. A modeling signal processor has the same amplifier modeling effects as a modeling amplifier but does not contain any power amplifier or loudspeakers. These devices can be used in a number of ways ranging from adding modeling capability to a non-modeling amplifier, allowing direct recording of an amplifier sound without ever having the sound be sent through speakers, and even allowing the guitarist to plug directly into a public address ("PA") system for a completely guitar amplifier-free setup during a live performance.

Although modeling systems allow a guitarist to get to the sound of a "classic" amplifier faster by combining many control parameters into a single "model select" control, they significantly reduce the number of possible sounds that can be achieved since the user is limited to the models provided by the product. Also, another limitation is that even if the modeling amplifiers are perfect recreations of the original amplifiers, the tonal characteristics can only be as good as the original amplifier. By only modeling known physical systems, the resulting model does not take advantage of tones that can be created without the physical constraints imposed by the materials and components used to construct these systems. Because these tones are based on mathematical models, the output from the digital signal processor of each product will sound identical. The net result of this is that musicians have a dramatically reduced number of tonal possibilities to choose and that the music being performed or made with these products is less likely to be tonally diverse. What is needed is an audio signal processing system that provides various tonal processing tools to generate a virtually unlimited number of models with new tonal characteristics.

SUMMARY

This invention provides a system capable of customizing musical instrument signal processing enabling the production of multiple tonal characteristics. A mathematical model of tonal characteristics is digitally created based on two or more initial mathematical models of tonal characteristics.

Upon simulating a first initial mathematical model of tonal characteristics and a second initial mathematical model of tonal characteristics, a new mathematical model may be created. By interpolating one or more coefficients of the first and second initial mathematical models and by adjusting a control parameter between a range of the first second value, the new mathematical model may be created.

When the control parameter is adjusted to the first value (first initial mathematical model); the control parameter is adjusted to the second value (second initial mathematical model); and the control parameter is adjusted between the first and second values, the mathematical model may represent a convergence between the first and second models. As an example, either amplifier or cabinet-speaker effects may be simulated using the above methodology.

This invention provides the musician with numerous mathematical model options. An unlimited number of special effects based on signal amplification and cabinet-speaker effect generation may be created. This system allows users to create the atmosphere from the signature characteristics of a user employing various amplifiers and/or loudspeakers.

This system also provides an infinite number of musical characteristics inherent with specific characteristics of known amplifiers or loudspeakers thus broadening the musical artist's palette of sounds. This increased flexibility provides the musical artist with the ability to create a user-unique sound and not forcing the artist to rely on a sound or model that the manufacturer has pre-selected. Simple user interfaces may be provided for performing complex sound manipulations and the realistic "touch" and "feel" of real amplifiers and loudspeaker cabinets that guitarists desire.

This also fosters interchange among users. New sounds can be shared with others via the Internet, web pages, user's groups, and the like. These sounds can then be added to a pool of existing models of amplifiers and loudspeaker cabinets and can then be used to create new and unique sounds. The user may be able to simulate and save the models of amplifiers and loudspeaker cabinets that may not have previously been in existence. Once saved, these amplifiers and loudspeaker cabinets models may be recalled providing users with a user defined sound characteristic signature.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood with reference to the following figures. The components in the figures are not necessarily to scale, emphasis instead being placed upon illustrating the principals of the invention. Moreover, in the figures, like reference numerals designate corresponding parts throughout the different views.

DESCRIPTION OF THE PREFERRED EMBODIMENT

This invention provides audio signal processing systems capable of generating new simulation models by using various complex mathematical algorithms to combine pre-existing models. These new "hyper models" may be created with techniques enabling the retention of the same level of complexity as the original models and, thus, may become an extension to the collection of available models in digital audio signal processing systems.

Traditionally, the term model referred to a system that mimics certain sound characteristics of another existing system. The term "hyper model" may be used to describe a model that extends the description of "model." The resulting hyper model may describe a "model" of an amplifier or cabinet-speaker system that is already in existence, and may also be used to describe a new system that may be impractical to physically build. Examples of this include changing the virtual size of a guitar amplifier cabinet and speaker system to include the size of an entire room or to create the tone of a guitar amplifier between a closed back 4×12" and an open back 2×12" configuration.

This invention also provides for "warping" or "morphing". These terms may be used to describe a control system to continuously transition the tonality of an amplifier, a cabinet-speaker system, or any other audio signal processing system, from one model to another. This invention provides a set of tools that users may use to create new tones by warping between the tonal characteristics of multiple models thus creating a hyper model. This new hyper model tone can then be saved in a memory storage area and recalled by users at a future date. Therefore, by warping or other subsequent manipulation, multiple generations of new models may be created based on two prior models, whether they are predefined models provided by the manufacturers of the audio signal processing system or newly created hyper models.

Although the electrical guitar may be described as a typical musical instrument, to one skilled in the art it is understood that similar techniques may be applied to other music instruments or sound producing devices. Any device whose audio signal can be digitally processed achieving particular composite tonal characteristics generated by traditional amplifiers and speakers may utilize these techniques.

Figure 1:
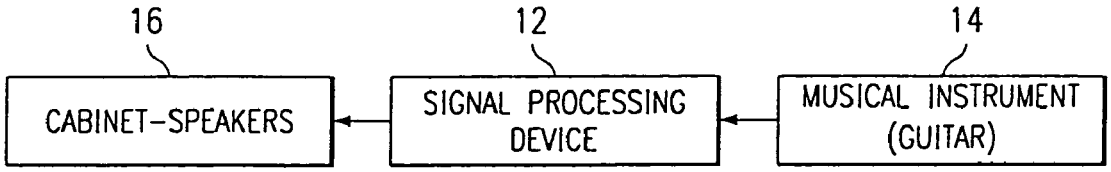
FIG. 1 is a block diagram illustrating a system providing customized musical instrument signal processing.

FIG. 1 is a block diagram illustrating a musical signal processing system where an audio signal processing system 12 is connected to a musical instrument 14 such as an electrical guitar. Also connected to the signal processing system 12 is an output system such as a speaker system 16.

Figure 2:
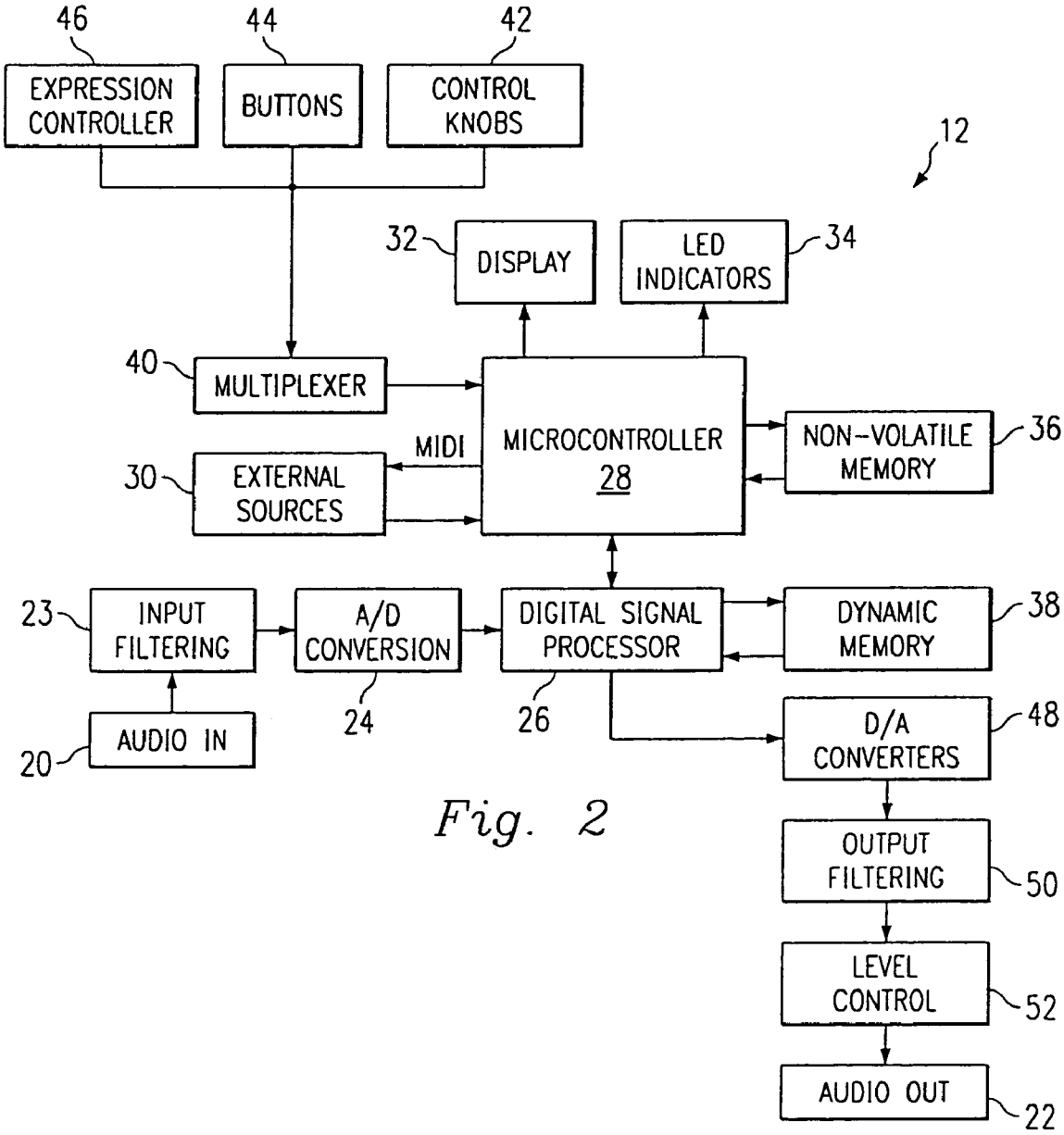
FIG. 2 is a block diagram illustrating an audio signal processing system.

FIG. 2 is a block diagram illustrating the interoperability of the signal processing system 12. An audio input 20 may be configured to receive signals from an electrical instrument that may can be processed through the signal processing system 12 to ultimately generate an audio output signal 22.

When the audio input 20 receives the incoming signals, the input signals may be filtered by a filter device 23. The filter device may comprise an anti-aliasing filter. The input signals may then be converted to a digital representation by an analog-to-digital device before transmitting the signals to a digital signal processor (DSP) 26. The DSP 26 may also interact with a microcontroller 28 to provide other programming information and controlling signals to the DSP 26. These control signals may be used for simulating various known characteristics of amplifiers or characteristics of various loudspeakers cabinets. For example, the microcontroller 28 may have a MIDI connection to an external source 30 where a particular simulation model for a specific type of amplifier may be downloaded to the microcontroller 28.

The microcontroller 28 may also control direct display devices such as a display screen 32 and LED indicators 34. A memory location 36 may be connected to the microcontroller 28 allowing for storing and recalling simulation models as desired by the user. The DSP 26 may also have a separate memory location 38 capable of caching or storing various data. A multiplexer 40 may also be connected to the microcontroller 28 enabling interaction with other components of the audio signal processing system 12 such as control knobs 42, buttons 44, and an expression controller 46.

After the DSP 26 finishes its processing of input signals, it sends its output to a digital-to-analog converter 48, and further to an output filtering mechanism 50. From that point on, a level control mechanism 52 may be used to adjust the level strength of the signal and may be sent out as the audio output 22. It is understood that the DSP 26 may work closely with the microcontroller 28 to process audio signals by receiving programming information. For example, a simulated model for a particular classic analog amplifier can be loaded directly from the non-volatile memory 36 or downloaded through the MIDI connection to the microcontroller to be used by the DSP. Various digital processing techniques may be implemented by the DSP 26.

Figure 3:
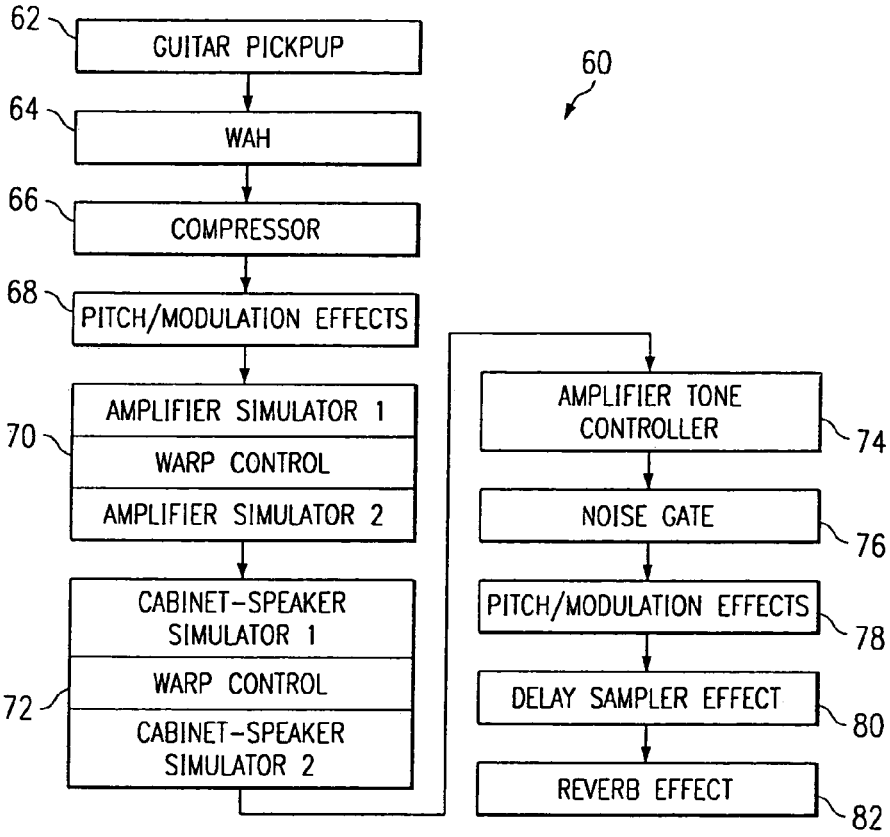
FIG. 3 is a block diagram illustrating a signal flow path within a signal processing device.

FIG. 3 illustrates a block flow diagram 60 showing a signal pathway within a digital signal processing device such as the DSP 26. The audio input from the instrument 14, such as a guitar, may be subjected to preliminary processing prior to reaching the DSP 26. In this example, inside the DSP, the audio input signals may be received by a guitar pickup simulator 62 before being passed to a Wah effect generator 64. Next, a compressor 66 and a pitch/modulation effects processor 68 may further modify and modulate the pitch of the signal to a user defined degree.

The output proceeds into two simulator subsystems: the amplifier simulator subsystem 70 and cabinet-speaker simulator subsystem 72. The function of the amplifier simulator subsystem 70 is to produce the tonal characteristics of a simulated amplifier or to create a new set of tonal characteristics based on two sets of tonal characteristics corresponding to two known amplifiers. Similarly, the cabinet-speaker simulator subsystem 72 is designed for emulating a particular cabinet speaker system, or for creating a unique set of tonal characteristics based on two known sets of tonal characteristics, that may correspond to two predetermined cabinet-speaker simulation models. Each set of tonal characteristics may be modeled by the DSP 26 using a mathematical model. By adjusting a control parameter such as a warp control, a new model may be created. Details for "warping" between two prior known models to create a new one is further described below with regard to FIG. 4.

Although both the amplifier simulator subsystem 70 and the cabinet-speaker simulator subsystem 72 may be connected in a sequential manner, it is not required for the signal to be processed through both of them or in such a sequence. For example, before a user performs on the instrument 14, the user may select whether both the amplifier warping and the cabinet-speaker warping is to be performed, and the specific order.

Following one or both of the two simulator subsystems 70 and 72, the audio signal path may proceed through an amplifier tone controller 74, a noise gate 76, another pitch/modulation effect generator 78, a delay sampler effect generator 80, and a reverb effect generator 82. These components apply additional digital signal processing schemes as desired by the user. The sequence of the different signal processing schemes (including the amplifier and cabinet warping) may be of any combination or in any order of selection. For example, the user may not need to do pitch modulation, thus eliminating the pitch/modulation effect generator 78.

The combined simulator subsystems 70 and 72 may provide a unique signal processing mechanism that includes features for modeling various guitar amplifiers and modeling cabinet-speakers. One feature of the amplifier simulator subsystem 70 or the cabinet-speaker subsystem 72 is to make variations of tonal characteristics of one or more predetermined simulation models. A control mechanism referred to as a warp control may be applied for (1) both simulating or recreating tonal characteristics of original physical amplifiers or cabinets; or (2) creating tonal characteristics of new simulated or synthesized amplifiers or cabinets.

In a simple analogy, the warp control may mix at least two known audio models of amplifiers or cabinet-speaker sets in a manner similar to mixing at least two cans of paint. The mixed tonal characteristics are a combination of the initial models, just as the mixture of different colors of paint results in a new color. Therefore, the warp control may determine the amount one model should exert influence in the final mix with regard to the other. In this manner, the simulator subsystems can generate distinctive new hybrid amplification effects or, cabinet effects, thus creating a new virtual amplifier or speaker model that may not exist or be possible in real world environments. Examples of such simulation model generation for amplifier simulator or cabinet-speaker simulator subsystem 70 or 72 is described in more detail in FIG. 4.

Figure 4:
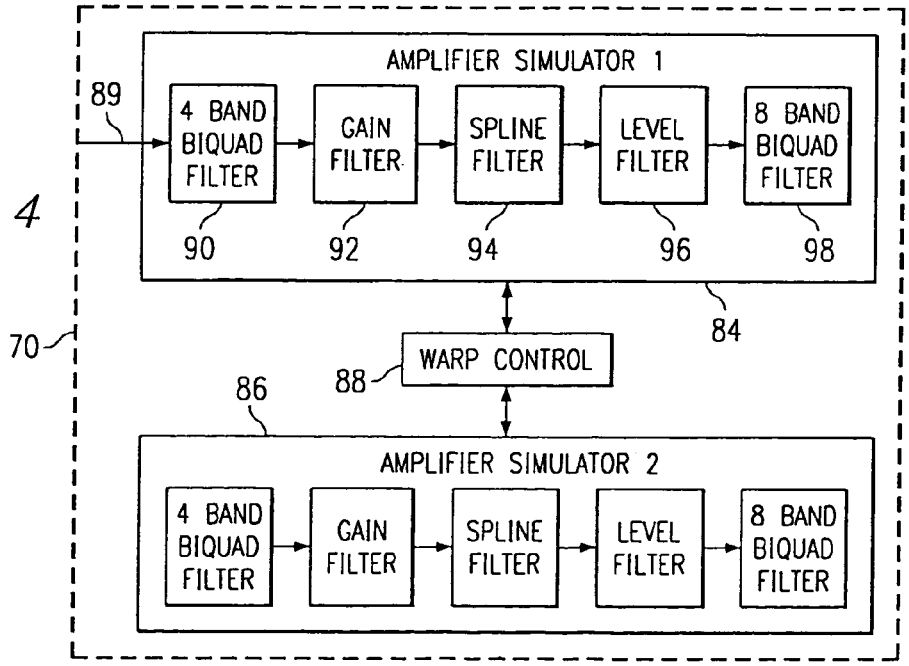
FIG. 4 is a block diagram illustrating one embodiment of an amplifier simulator subsystem of the device of FIG. 3.

FIG. 4 is a schematic for an implementation of the amplifier simulator subsystem 70 of FIG. 3 using the DSP 26. The amplifier simulator subsystem 70 may have two amplifier simulators 84 and 86 formed by a group of filters that are programmed with predetermined algorithms. The warp control module 88 of the amplifier simulator subsystem 70 may manipulate the signal data going through such a group of linear and non-linear filters in order to complete the morphing or warping.

In FIG. 4, a five-filter system is illustrated. An input signal 89 to the amplifier simulator subsystem 70 is passed through a linear filter such as a 4-band biquad filter 90, a gain filter 92, a non-linear filter such as a spline filter 94, a level filter 96, and a 8-band biquad filter 98. Mathematically, the filtering mechanism of each filter can be described by a formula and simulated by the DSP 26. For example, a one-band biquad filter may be described as:

$$H(z) = \frac{a_0 + a_1 z^{-1} + a_2 z^{-2}}{1 + b_1 z^{-1} + b_2 z^{-2}}$$

and a cubic rational bell-spline filter (commonly known as a spline filter) mapping an input to an output can be dissected into different regions based on the input where each region can be represented as a cubic polynomial:

$$f(x)=c_3x^3+c_2x^2+c_1x+c_0.$$

The spline filter takes a linear input signal and produces a non-linear output to distort the input signal. Because the non-linear feature of the spline filter 94 produces harmonics above fundamental Nyquist rate, oversampling of the input signal is needed to reduce aliasing effects as a commonly known signal processing technique. The nonlinear protions of any filter may be oversampled to eliminate aliasing. As an example, a 32-region spline filter may take in a digital input between −16 and 16, whose integer portion is known as a spline segment. This integer portion of the input serves as an index-to identify a corresponding spline region (or, a group of coefficients) from a data source from a memory space (e.g., lookup tables), while the fraction portion is the input to the polynomial representing the filter (e.g., the "x" in the above formula). It is noted that although the spline filter alone had multiple groups of coefficients for multiple regions, these groups of coefficients are still a part of a bigger set of coefficients that contains all the coefficients required for all components of the amplifier simulator subsystem. The warp control module 88 may manipulate and process the input signal 89 to the amplifier simulator subsystem 70 by controlling all the coefficients of relevant formulas.

A particular set of coefficients for all relevant predetermined formulas used for all components either by the amplifier simulator subsystem 70 or by the cabinet simulator subsystem 72 can be viewed as a simulation "model." If these coefficients are set to predetermined values, the tonal characteristics of an amplifier or cabinet model may be determined.

Therefore, it is also possible to store sets of coefficients or models in a recallable memory location accessible by the digital signal processor. A library containing lookup tables may be prepared to store these unique models. For example, a model for a British Stack guitar amplifier should have a unique set of coefficients different from that of an American Combo guitar amplifier. These models, or sets of coefficients, do not have to correspond to amplifiers or cabinets existing in the market. They can be for virtual amplifiers or cabinets generated purely based on mathematical manipulation of corresponding coefficient sets. If two simulation models for two amplifiers of known brands are warped to create a new model, the new model most likely will not match any known amplifier. Since any amplifier is represented as a model through the coefficients, as long as there are at least two known models, or two known sets of coefficients, a new model can be created.

Using the amplifier simulator subsystem, various tonal characteristics can be produced. For example, an amplifier warping feature may use two prior amplifier simulation models and combine them together with a predetermined control that generates new amplification effects. This is accomplished by interpolating each model's respective coefficients to create a new model. For instance, the interpolation is performed on the coefficients of each biquad and spline filter in the respective amplifier simulator. This newly created model can function as one of the two initial models for the creation of additional models. Consequently, the possibilities to create new models are almost infinite, and are not limited by the availability of any physical amplifiers on the market.

In the example shown in FIG. 4, a total of 12 bands of the biquad filters are used. In this case, each coefficient of one amplifier may be linearly interpolated with the coefficient of the other amplifier (e.g., amplifier simulator 2) using a control parameter W provided by the warp control module 58. Assuming that each biquad filter within the amplifier simulator 1 (or the first initial mathematical model) can be represented as:

$$Amp1:\ H_1(Z) = \frac{a_{x0} + a_{x1} z^{-1} + a_{x2} z^{-2}}{1 + b_{x1} z^{-1} + b_{x2} z^{-2}}$$

and the amplifier simulator 2 (or the second initial mathematical model) can be represented similarly as:

$$Amp2:\ H_2(Z) = \frac{a_{y0} + a_{y1} z^{-1} + a_{y2} z^{-2}}{1 + b_{y1} z^{-1} + b_{y2} z^{-2}}$$

therefore, the new model created can be represented by:

$$H_w(Z) = \frac{\sum_{n=0}^{2} ((1-W)a_{xn} + Wa_{yn})z^{-n}}{1 + \sum_{n=1}^{2} ((1-W)b_{xn} + Wb_{yn})z^{-n}}$$

where W is referred to as a control parameter known as a warp parameter having a value between zero and one. This interpolation process is repeated on the 4 bands of the biquad filter before the spline filter and on the 8 bands of the biquad filter after the spline filter.

In the spline filter, another interpolation process is carried out. For example, if every given region of the spline filter of the amplifier simulator 1 is represented as:

$$S_1(x)=a_3x^3+a_2x^2+a_1x+a_0$$

and every given region of the spline filter of the amplifier simulator 2 is represented as:

$$S_2(x)=b_3x^3+b_2x^2+b_1x+b_0$$

the linear interpolation creates the a morphed or warped signal for that region as:

$$S_3(x)=c_3x^3+c_2x^2+c_1x+c_0$$

where $$c_n = \sum_{n=0}^{3} (1-W)a_n + Wb_n$$

and W is, again, the warp parameter having a value between zero and one.

As to the gain and level filters of each amplifier simulator, the signal data going through them are expressed and dealt with in a dB form. In order to keep the overall level of the model consistent as the warp parameter W changes, the gain and level filtering may also be linearly interpolated as dB values. Therefore, $$C_{GdB}=(1-W)A_{GdB}+WB_{GdB}$$

$$C_{LdB}=(1-W)A_{LdB}+WB_{LdB}$$

where $A_{GdB}$ represents a gain filtering factor in dB for amplifier simulator 1, and $B_{GdB}$ represents a gain filtering factor in dB for amplifier simulator 2, and $A_{LdB}$ represents a level filtering factor in dB for amplifier simulator 1, and $B_{LdB}$ represents a level filtering factor in dB for amplifier simulator 2. $C_{GdB}$ and $C_{LdB}$ are the representations for gain and level factors for the models respectively.

Similar data processing and sound effect manipulations may also be done for the cabinet-speaker simulator subsystem 72 (FIG. 3). In one example, the cabinet-speaker simulator can be implemented by a Finite Impulse Response (FIR) filter such as a 128-tap FIR filter. It can also be represented as:

$$H(z)=a_0+a_1z^{-1}+a_2z^{-2}+\ldots+a_{127}z^{-127}$$

the coefficients of which can again be controlled to produce the simulation effect desired. Therefore, different sets of the coefficients correspond to different cabinets, and the simulation model is dependent on these coefficient sets. For instance, to simulate British 4×12 cabinets, a unique set of coefficients are chosen, and for American 2×12 cabinets, another unique set of coefficients are used although the framework of the mathematical model remains the same.

Once a cabinet-speaker simulation model is fully defined, there are several major signal processing control features that the cabinet-speaker simulator subsystem 72 provides to users. They are, among others, cabinet warping, cabinet phase shifting, and cabinet tuning, all intending to create more tonal or sound characteristics. The cabinet control features can simulate tonal characteristics of known original cabinets, which mimic actual loudspeaker cabinets using well-known linear system identification techniques, or generate synthesized cabinets derived purely by digital signal processing systems such as the system 12.

The cabinet warping feature interpolates the FIR coefficients of the two initial cabinet-speaker simulators, wherein each cabinet-speaker simulator may use one or more FIR filter for its simulation purpose. The result of the cabinet warping combines the tonal characteristics of the initial cabinet-speaker simulators to give the tonal characteristics of a new virtual cabinet-speaker set. In one example, a linear interpolation is imposed with a control parameter known also as a warp parameter W. Assuming, cabinet-speaker simulator 1 is represented as:

$$H_1(z)=a_0+a_1z^{-1}+a_2z^{-2}+\ldots+a_Lz^{-L}=\sum_{n=0}^{L}a_nz^{-n}$$

and cabinet-speaker simulator 2 is represented as:

$$H_2(z)=b_0+b_1z^{-1}+b_2z^{-2}+\ldots+b_Lz^{-L}=\sum_{n=0}^{L}b_nz^{-n}$$

where L is the number of taps that a FIR filter has. With the warp parameter W in control, the interpolation results in:

$$H_3(z)=c_0+c_1z^{-1}+c_2z^{-2}+\ldots+c_Lz^{-L}$$

where W is between zero and one, where L=128 for a 128 tap FIR filter, and where $$c_0=Wa_0+(1-W)b_0$$

$$c_1=Wa_1+(1-W)b_1$$

.CL=WaL+(1−W)bL. The cabinet phase shifting feature allows a cabinet-speaker simulator to be shifted in time with relation to another cabinet-speaker simulator. This feature can be used in combination of the warping mechanism as described above. For example, this process may again use two initial FIR filters with L number of taps and combines them together with both a control parameter W that weights the two respective FIR filter taps and another control parameter P that offsets the taps of one filter with respect to the other. For example, the combined signal can be represented as:

$$H(z)=\sum_{A=0}^{L}(Wa_n+(1-W)b_{n-p})z^{-n}$$

where "p" is the offset of the coeficient set for the cabinet-speaker simulator 1 with respect to that for the cabinet-speaker simulator 2.

Although the symbol "W" is used above in various formulas, it just represents generically a control parameter imposed in different stages of the signal processing involved and it may have different values in these different signal processing applications. For example, the W for the amplifier models can be adjusted simultaneously with the W for the cabinet models, but they can be controlled separately and have different values.

In addition to the phase shifting feature, a cabinet tuning feature applies pitch-shifting techniques to certain filters' coefficients to "tune" the cabinet-speaker simulator (or the simulated loudspeaker cabinet). That is, by carefully adjusting the coefficients, the simulation result equates to that caused by a change in the sample rate, thereby creating the effects of a new cabinet-speaker. As such, although the sample rate of the system does not change at all, a virtual sample rate is "created." For example, since high-order FIR filters can be used to implement the simulation of a new loudspeaker cabinet, and assuming a 128 tap FIR filter is used, before the pitch shift, the mathematical representation of the FIR filter is:

$$H(z)=a_0+a_1z^{-N}+a_2z^{-2N}+\ldots+a_{127}z^{-127N}$$

where N is (1/system sample rate). After the pitch shift, the representation is:

$$H(z)=a_0+a_1z^{-M}+a_2z^{-2M}+\ldots+a_{127}z^{-127M}$$

where M is (1/virtual sample rate). It is understood that this virtual sample rate is a variable of the system adjustable by a user in order to control the amount of cabinet tuning. In effect, by adjusting this virtual sample rate, the user resizes the cabinet-speaker combination. This cabinet tuning feature may require as few as one initial simulation model.

A refinement of the amplifier warping and cabinet-speaker warping features can be implemented toward a discrete frequency band. For instance, the entire frequency spectrum of the signal can be divided into N number of bands, and each band can have its own amplification and cabinet-speaker warping done separately. The user can select a frequency range of interest within a known model to warp into another by the techniques described above. This is also referred to as amplifier and cabinet frequency band split warping.

Figure 5:
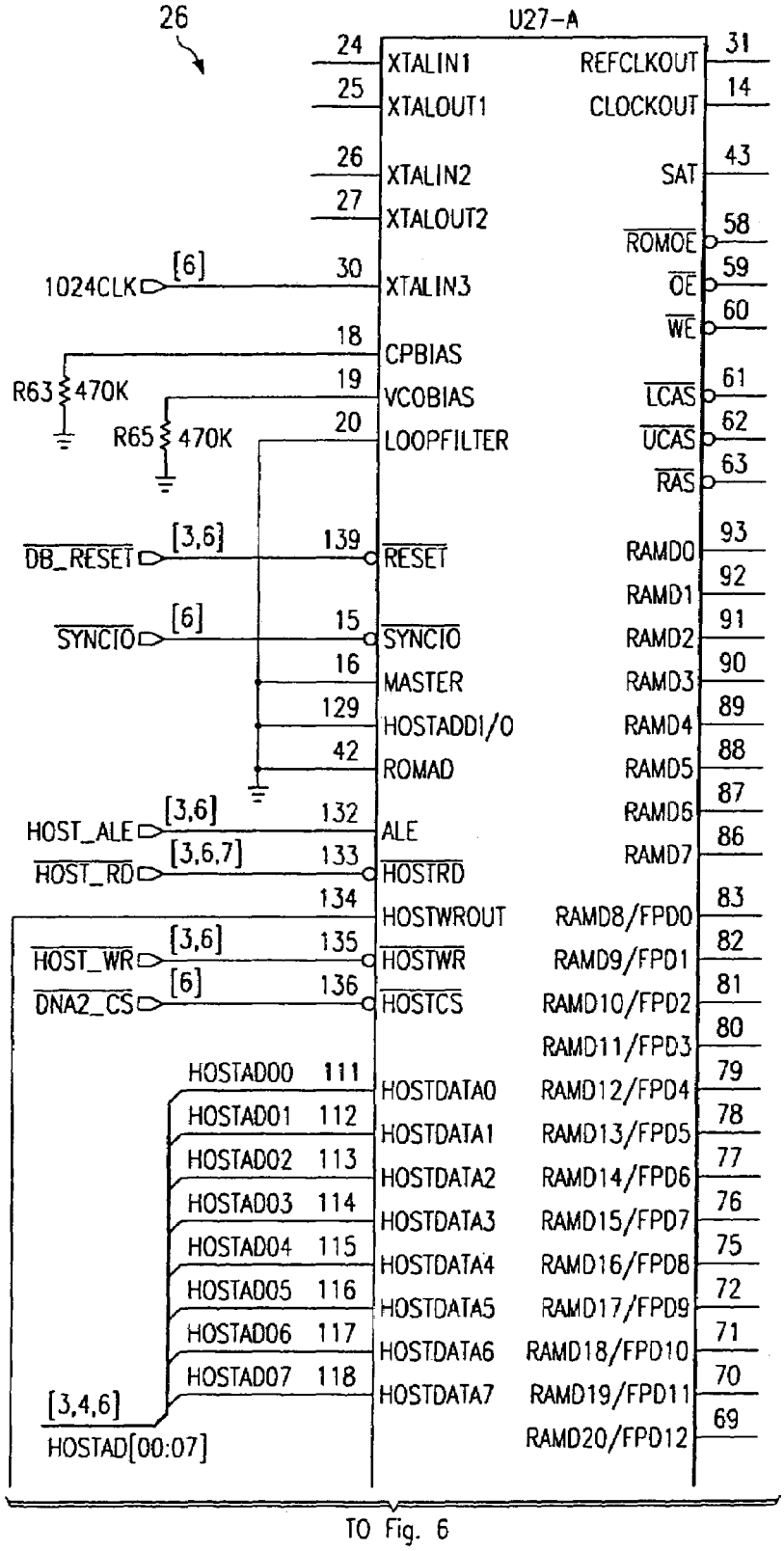
FIG. 5 is a circuit diagram illustrating the signal pathways for a digital signal processor.
Figure 6:
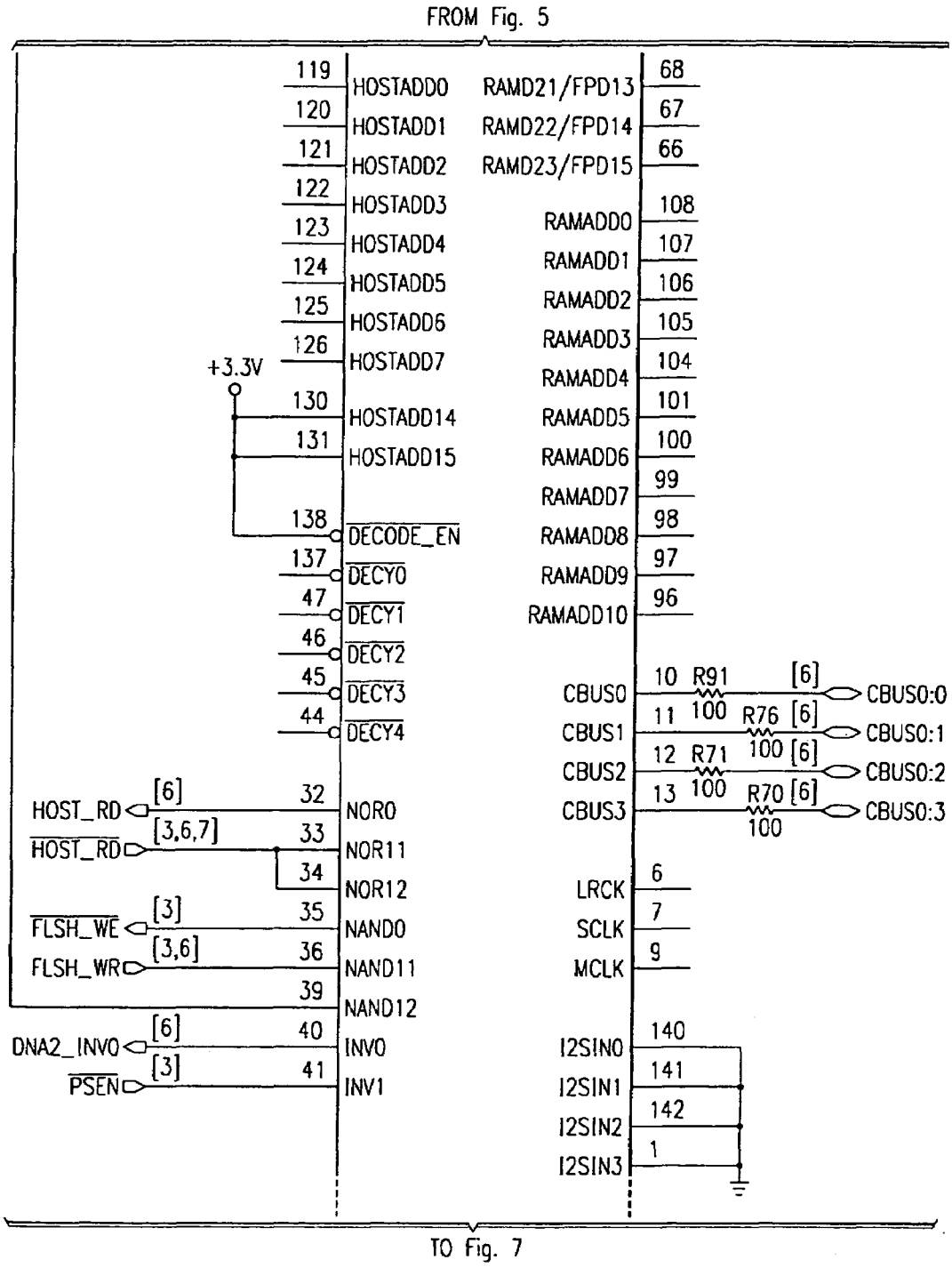
FIG. 6 is a circuit diagram illustrating the signal pathways for a digital signal processor.
Figure 7:
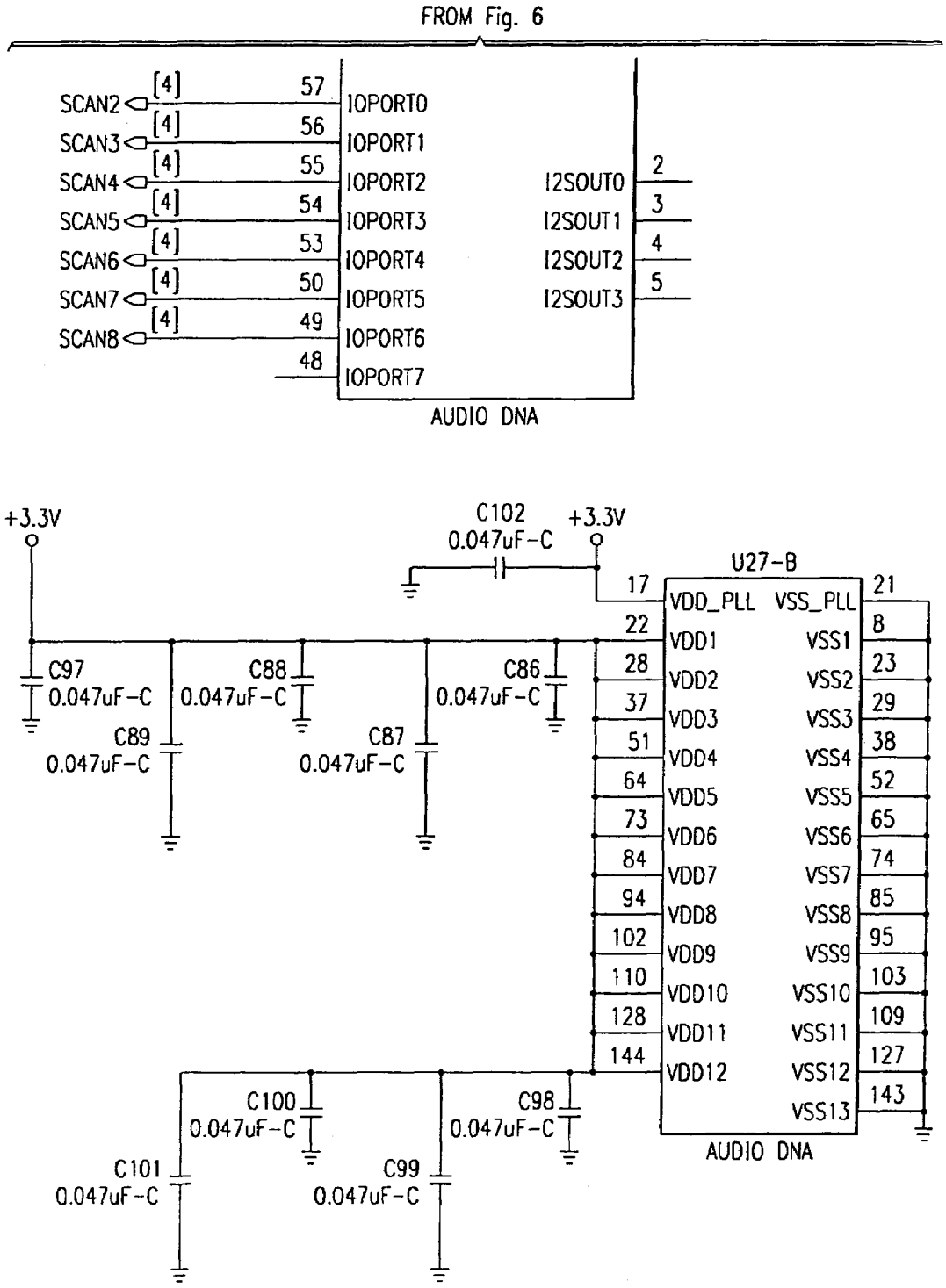
FIG. 7 is a circuit diagram illustrating the signal pathways for a digital signal processor.

FIGS. 5–7 are circuit schematics illustrating an example of the DSP 26. Implementation in the form of a digital signal processor is useful and cost effective for meeting various signal processing needs. For example, the amplifier simulators with their warp control, or the cabinet-speaker simulators with their warp control, can be fully implemented by programming the DSP 26. As stated above, components shown in the entire schematic of FIG. 4 can be implemented by generating appropriate programs for the DSP 26. Commercially available DSPs made by any manufacturers can be similarly integrated and programmed to achieve the disclosed functions. Furthermore, based on the degree of circuit integration of the DSP, a single or multiple DSP chips may be used. Although a DSP chip is described above as one implementation of the system, the use of the DSP is not mandatory. Any other processing mechanism, hardware or software, that can perform necessary calculations to effect the mathematical manipulations described above can be used instead of the DSP. Moreover, it is fully contemplated that a pure software approach may be taken to achieve all the functions that are necessary for signal processing.

All the programs (not shown) generated for the DSP 26 are formatted in a predetermined manner to be usable by any product design based on the disclosure as described above. In other words, the programs are portable and not exclusive to one product. Therefore, the programs can be shared between users of different products by the use of software and protocols developed for signal processing systems. For example, the Internet can be used as a transport mechanism to facilitate memory storage requirements exchange of these programs by users.

FIGS. 8–11 are sample user interfaces for the system 12 implemented, in the example, as a guitar signal processing device 100. For example, referring to the display 100, assuming the guitarist's intention is to incorporate the model of a vintage Tweed amplifier with an American 2×12 cabinet, and the model of a Rectified Amplifier with a British 4×12 cabinet to create a new model (which has its own unique set of coefficients), the following description explains a procedure to create and store such a model.

Figure 8:
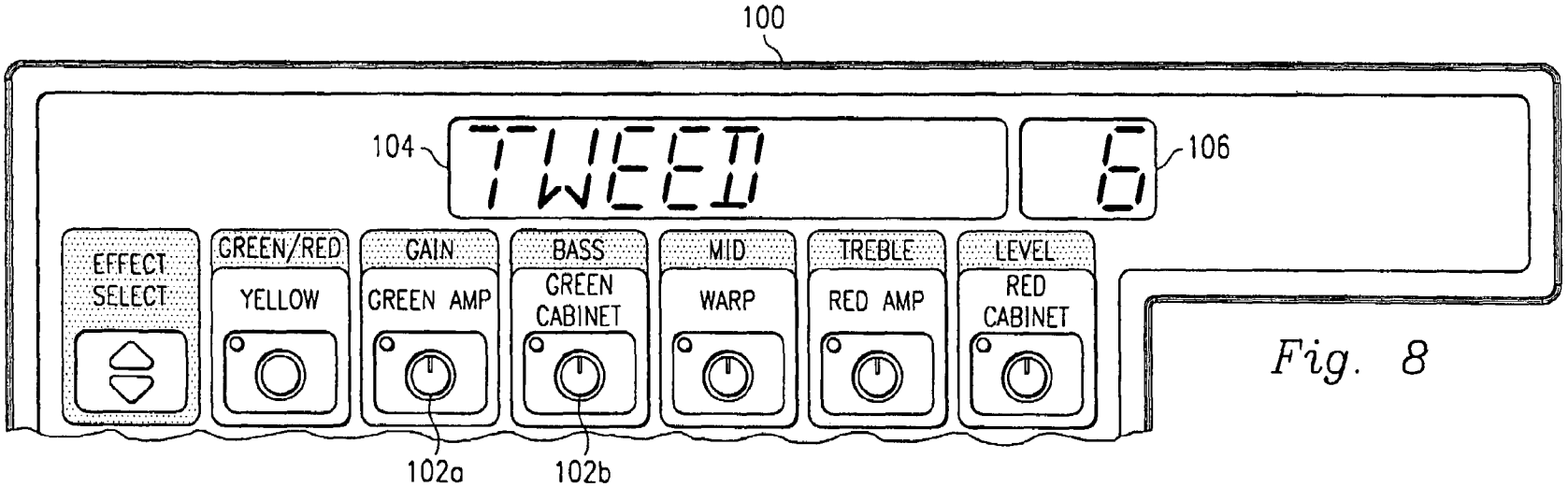
FIG. 8 is a screen display of a graphical user interface for customizing musical effects.

First, an identifier may be assigned to represent the to-be-created model. The created model can be retrieved repetitively from a memory space of the guitar signal processing device by using the assigned identifier. Since the model is created based on two prior simulation models, the two models must first be selected. On the device 100 as shown in FIG. 8, two knobs 102*a* and 102*b*, that are labeled as "Green Amp" and "Green Cabinet" respectively, are marked for constructing and adjusting an amplifier and cabinet combination of a first channel or a first model. Assuming both simulation models for the Tweed amplifier and the American 2×12 cabinet are predefined, by turning the knobs 102*a, b* sequentially, the desired amplifier-cabinet combination can be located. For example, when turning the amplifier knob for searching the Tweed amplifier, the display 104 shows the term "Tweed" when it is found.

Figure 9:
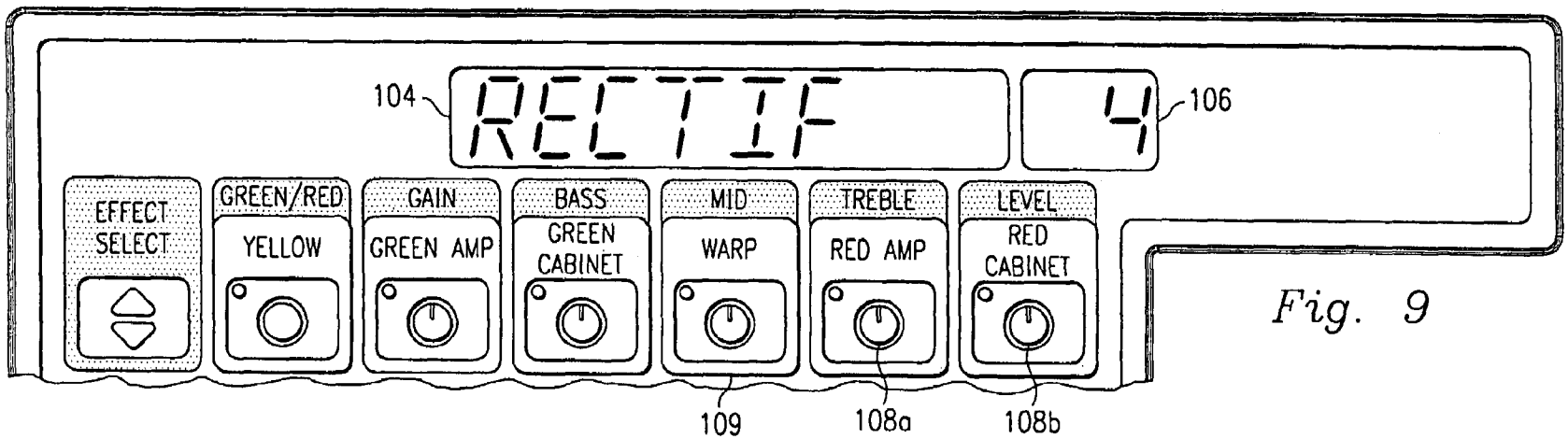
FIG. 9 is a screen display of a graphical user interface for customizing musical effects.

Another display 106 shows a numeric identifier corresponding to the Tweed amplifier, in this case, a numeral "6" as shown in FIG. 8. Similarly, the desired predetermined cabinet model can be found by turning the knob 102*b*. Once the first initial model (the "green" amp/cabinet combination) is selected, the guitarist turns to select another initial model by using another two knobs 108*a* and 108*b*, marked as "Red Amp" and "Red Cabinet" respectively (as shown in FIG. 9). The same "knob-turning" process proceeds to find the second initial model (the "red" amp/cabinet combination) simulating the Rectified amplifier and the British 4×12 cabinet combination. Once found, as shown in FIG. 9, the display 104 and 106 will show corresponding identifiers for the Rectified amplifier and the British cabinet stack. The knob 109 is referred to as a "Warp" knob and provides for user manipulation of the warp control function. By rotating the Warp knob, the two initial models are combined to create a new model. Typically, the initial simulation models for the amplifier-cabinet combinations implement factory default settings for parameters such as the Gain, EQ, and Level parameters. These settings may not necessarily suit the guitarist's personal taste, and may require some further tuning.

Figure 10:
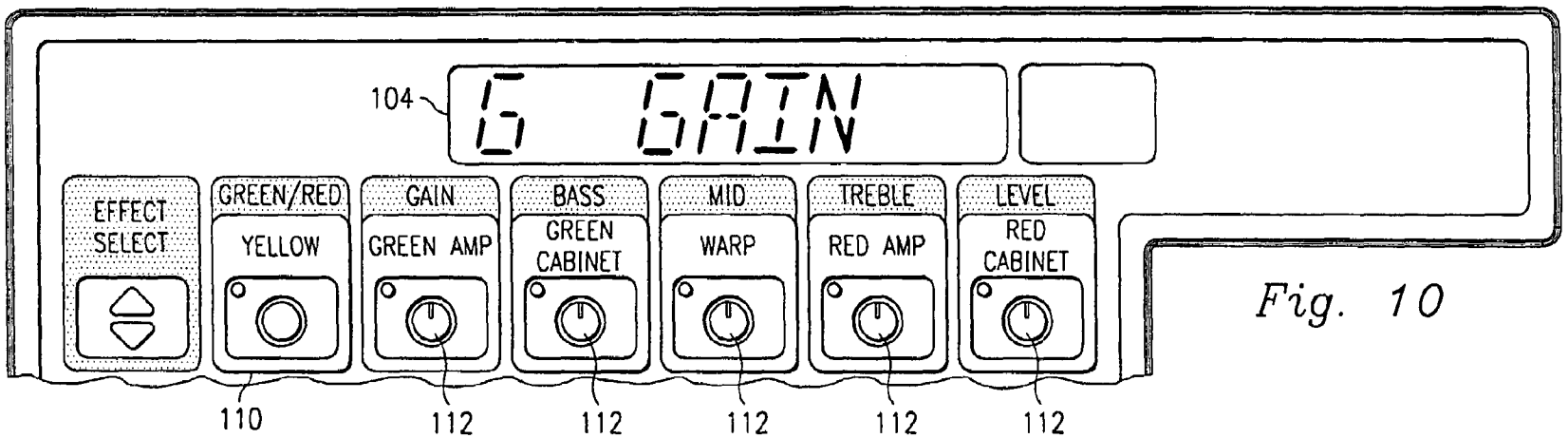
FIG. 10 is a screen display of a graphical user interface for customizing musical effects.
Figure 11:
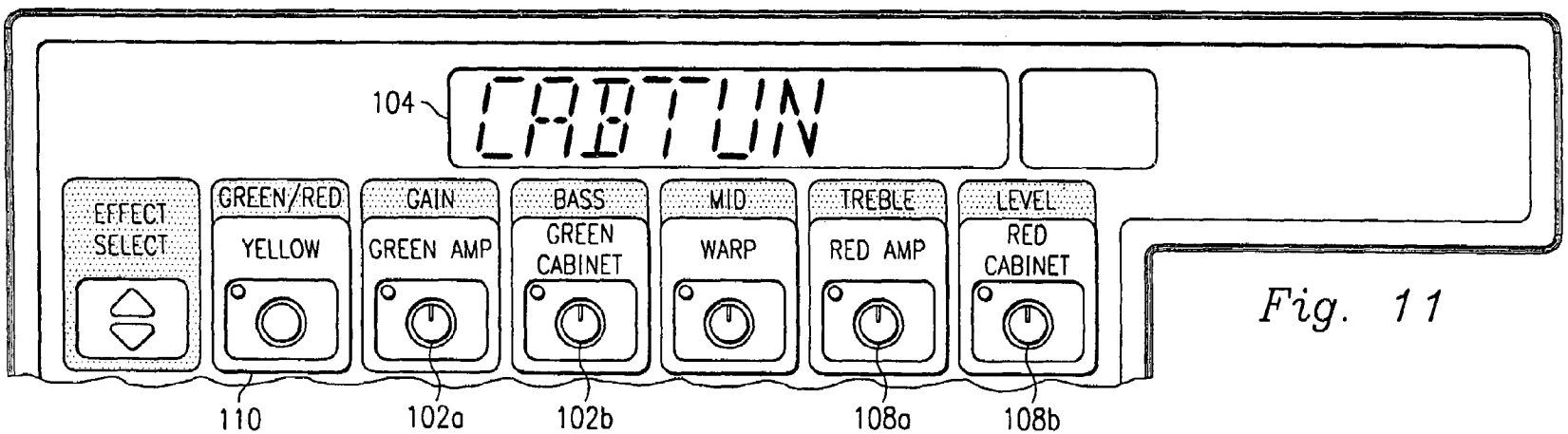
FIG. 11 is a screen display of a graphical user interface for customizing musical effects.

As shown in FIG. 10, by pressing a status button 110, the knob set 112 (including the knobs 102, 108, and 109) now functions as an individual control knob for multiple parameters such as gain, bass, mids, treble, and level for the Tweed amplifier. Likewise, by pressing the status button 110 again, the parameters for the Rectified amplifier are now ready for fine tuning. Using the same knob set, cabinet parameters can be adjusted. It is also possible to adjust the cabinet tuning for the simulated American 2×12 and the British 4×12 cabinets. For example, as shown in FIG. 11, the status button 110 can be pressed and held until the display 104 shows "CABTUN" indicating that cabinet tuning is available. Then, one of the two knobs 102 may be used to fine tune the American 2×12, and similarly, one of the two knobs 108 may be used to fine tune the British 4×12. Once the cabinet tuning is done, the status button 110 can be pressed one more time to return the device 100 to a performance mode.

After the first and second prior simulation models are fully programmed, the guitarist can create another model by tuning the Warp knob to a desired location and testing the effects by playing a guitar connected to the guitar signaling device 100. The newly created model can then be saved to a memory location as an amplifier-cabinet simulation model accessible by the guitar signal processing device 100 (not shown), and indexed by an identifier created by the guitarist.

Figure 12:
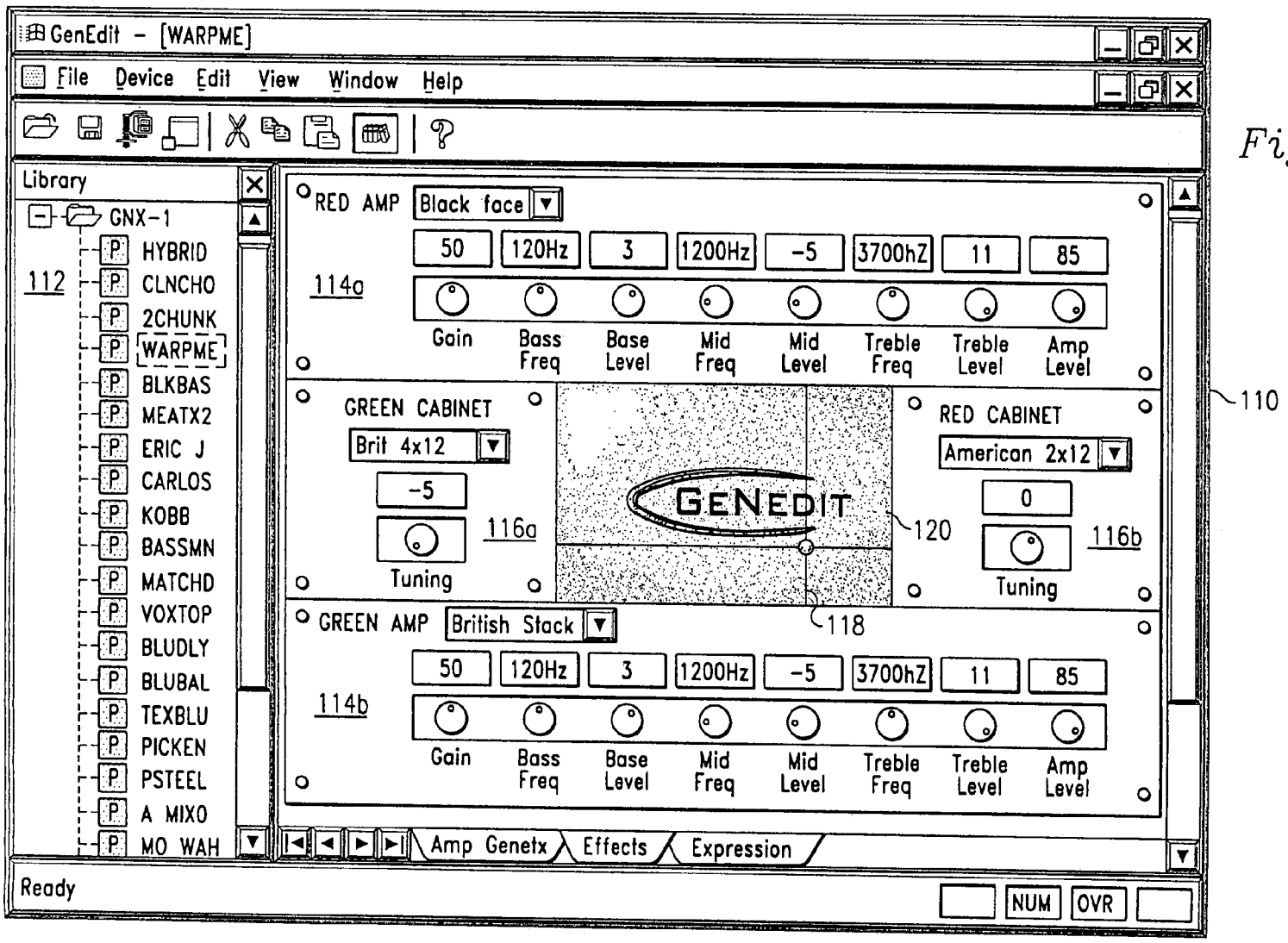
FIG. 12 is a screen display of a graphical user interface for customizing musical effects.

FIG. 12 illustrates a graphic user interface (GUI) created by musical signal processing software operable with a computer such as a user's personal computer (PC). The function of this software is to turn the PC into an external control for an audio signal processing system. For example, a guitarist can connect his digital guitar to the PC, which is further connected to a speaker set. In FIG. 12, a portion of the GUI 110 is a display area 112 identifying all information for both the amplifiers and the cabinets. Two control areas 114*a* and 114*b* represent two models for the amplifiers and their relevant controls, and another two control areas 116*a* and 116*b* represent those for the cabinets. The center portion 118 of the GUI 110 represents a control area functioning similarly as the warp control knob described above. With two amplifier models located at the top and bottom and two cabinet models located on both sides, this center portion 118 becomes a two-dimensional control pane whereas by moving a ball icon 120 in the pane, the control parameters of the amplifiers, as well as the cabinets, are changing accordingly resulting in a "warping" feature. The warping of the amplifiers and the cabinets can be controlled sequentially as well as simultaneously. Once the user finds his desired combination, the setup can be saved in the PC or downloaded to a digital signal processing system as a new model. The new model is then available for the user to send to other receiving devices such as another PC of another user. In effect, a user can share customized model with others.

In summary, a system for digitally creating a new mathematical model of tonal characteristics is provided based on two or more initial mathematical models of tonal characteristics to achieve special musical effects. A first initial mathematical model of tonal characteristics is simulated, followed by a second initial mathematical model of tonal characteristics is also simulated. The creation of a new mathematical model is implemented by interpolating one or more coefficients of the first and second initial mathematical models and by adjusting a control parameter, the control parameter being adjustable in a range between a first value and a second value such that when the control parameter is the first value, the new mathematical model is the first initial mathematical model, and when the control parameter is the second value, the new mathematical model is the second initial mathematical model, and wherein when the control parameter is varied to a point between the first and second values, the new mathematical model represents a corresponding convergence between the first and second models. This system can be used for warping between two initial amplifier simulation models or two cabinet-speaker simulation models to create new models, that produces special musical effects when integrated with the performance of a musical instrument such as an electrical guitar.

In addition, the concept of warping between two prior simulation models is not limited to the applications for simulating the amplifiers or cabinets as described above. It should be well understood by one skilled in the art that any other DSP effects (e.g. reverb, modulation effects, delays, etc.) that can be simulated or represented based on a mathematical model may implement the techniques described in this invention. Provided that there are two prior simulation models available, they can be warped in the same manner as the amplifier warping or cabinet warping to create a new model, thus generating distinct and/or new effects.

The system enjoys numerous benefits. For example, it provides a digital audio signal processing system -with simple interface for performing complex sound manipulations and the realistic "touch" and "feel" of real amplifiers and loudspeaker cabinets that guitarists desire. This allows users to customize or create virtual models for amplifiers and loudspeaker cabinets that may not be available on the market, or even possible to build. Thus, the artist's palette of sounds is broadened with infinite possibilities further providing user-unique guitar sound. This also allows users to not have to rely on a sound that the manufacturer of the product suggests. New models can be shared with others via the Internet, web pages, user's groups, etc. These models can then be added to a pool of existing models for amplifiers and loudspeaker cabinets and can then be used to further create newer models.

While various embodiments of the application have been described, it will be apparent to those of ordinary skill in the art that many more embodiments and implementations are possible within the scope of this invention. Accordingly, the invention is not to be restricted except in light of the attached claims and their equivalents.

What is claimed is:

1. A system for processing an audio signal, comprising:

a first simulation model;

a second simulation model; and a simulation model generator coupled with the first and second simulation models, the simulation model generator capable of warping between the first and second simulation models, thereby producing a generated simulation model, wherein the generated simulation model receives and processes the audio signal.

2. The system of claim 1, where the first simulation model, the second simulation model and the generated simulation model all comprise at least one of an amplifier simulation model, a cabinet simulation model, a reverb simulation model, a time-variant effect simulation model, and a delays simulation model.

3. The system of claim 2, where the time-variant effect simulation model includes a modulation effects simulation model.

4. The system of claim 3, where the modulation effects simulation model includes an effect selected from a group comprising a chorus modulation effect, a flanger modulation effect, a phaser modulation effect, a pitch-shifter modulation effect, a rotary simulator modulation effect, and an intelligent harmony modulation effect.

5. The system of claim 3 where the system is implemented by computer logic according to computer-executed instructions stored in a computer-readable medium.

6. The system of claim 3 where the system is implemented by computer logic according to computer-executed instructions embodied in a computer-readable electromagnetic signal.

7. A system for processing an audio signal, comprising:

a first cabinet speaker simulator;

a second cabinet speaker simulator; and a warp control coupled with the first cabinet speaker simulator and the second cabinet speaker subsystem and where the warp control receives and customizes the audio signal as a function of the first and second cabinet speaker simulators.

8. The system of claim 7 where the system is implemented by computer logic according to computer-executed instructions stored in a computer-readable medium.

9. The system of claim 7 where the system is implemented by computer logic according to computer-executed instructions embodied in a computer-readable electromagnetic signal.

10. A system for processing an audio signal, comprising:

a cabinet-speaker simulator for processing the audio signal and including a cabinet simulation model that is a function of a sample rate; and a user control in communication with the cabinet-speaker simulator and simulating an effect of a change in the sample rate.

11. The system of claim 10, where the user control includes a virtual sampling rate.

12. The system of claim 11, where the virtual sampling rate is a function of the sampling rate.

13. The system of claim 10, where the user control includes a user-controllable variable.

14. The system of claim 13, where the user-controllable variable is a function of the sampling rate.

15. The system of claim 14, where the cabinet simulation model includes an finite impulse response filter that is a function of the user-controllable variable.

16. The system of claim 15, where the finite impulse response filter (H(z)) is further a function of a number of filter taps (L), a plurality of coefficients ($a_0, a_1, \ldots, a_L$), an inverse of the user-controllable variable (M), and an equation $H(z)=a_0+a_1z^{-M}+a_2z^{-2M}+\ldots+a_Lz^{-LM}$.

17. The system of claim 10 where the system is implemented by computer logic according to computer-executed instructions stored in a computer-readable medium.

18. The system of claim 10, where the system is implemented by computer logic according to computer-executed instructions embodied in a computer-readable electromagnetic signal.

19. A method for processing an audio signal, comprising:

warping between a first simulation model and a second simulation model, thereby producing a generated simulation model.

20. The method of claim 19, where the first simulation model, the second simulation model and the generated simulation model all comprise at least one of an amplifier simulation model, a cabinet simulation model, a reverb simulation model, a time-variant effect simulation model, and a delays simulation model.

21. The method of claim 20, where the time-variant effect simulation model includes a modulation effects simulation model.

22. The method of claim 21, where the modulation effects simulation model includes an effect selected from a group comprising a chorus modulation effect, a flanger modulation effect, a phaser modulation effect, a pitch-shifter modulation effect, a rotary simulator modulation effect, and an intelligent harmony modulation effect.

23. The method of claim 19 where the method is implemented by computer logic according to computer-executed instructions stored in a computer-readable medium.

24. The method of claim 19 where the method is implemented by computer logic according to computer-executed instructions embodied in a computer-readable electromagnetic signal.

25. A method for processing an audio signal, comprising:

providing a cabinet simulation model that is a function of a sampling rate for processing the audio signal; and simulating an effect of a change in the sample rate.

26. The method of claim 25, where simulating the effect of the change in the sample rate in the cabinet simulation model includes making the cabinet simulation model a function of a virtual sampling rate.

27. The method of claim 25, where the virtual sampling rate is a function of the sampling rate.

28. The method of claim 25, where simulating the effect of the change in the sample rate in the cabinet simulation model includes making the cabinet simulation model a function of a user-controllable variable.

29. The method of claim 28, where the user-controllable variable is a function of the sampling rate.

30. The method of claim 28, where making the cabinet simulation model the function of the user-controllable variable includes defining the cabinet simulation model by a finite impulse response filter that is a function of the user-controllable variable.

31. The method of claim 30, where the finite impulse response filter (H(z)) is further a function of a number of filter taps (L), a plurality of coefficients ($a_0, a_1, \ldots, a_L$), an inverse of the user-controllable variable (M), and an equation $H(z)=a_0+a_1z^{-M}+a_2z^{-2M}+\ldots+a_Lz^{-LM}$.

32. The method of claim 25 where the method is implemented by computer logic according to computer-executed instructions stored in a computer-readable medium.

33. The method of claim 25 where the method is implemented by computer logic according to computer-executed instructions embodied in a computer-readable electromagnetic signal.

* * * * *